US011806635B2

(12) United States Patent
Bell

(10) Patent No.: US 11,806,635 B2
(45) Date of Patent: Nov. 7, 2023

(54) ROTATING SPIN TOP DEVICE

(71) Applicant: George Bell, Louisville, CO (US)

(72) Inventor: George Bell, Louisville, CO (US)

( * ) Notice: Subject to any disclaimer, the term of this patent is extended or adjusted under 35 U.S.C. 154(b) by 83 days.

(21) Appl. No.: 17/697,000

(22) Filed: Mar. 17, 2022

(65) Prior Publication Data

US 2023/0294007 A1 Sep. 21, 2023

(51) Int. Cl.
*A63H 1/00* (2019.01)
*A63B 43/04* (2006.01)

(52) U.S. Cl.
CPC ..... *A63H 1/00* (2013.01); *A63B 43/04* (2013.01)

(58) Field of Classification Search
CPC ..... A63B 37/10; A63B 43/04; A63H 1/00
See application file for complete search history.

(56) References Cited

U.S. PATENT DOCUMENTS

| | | | | |
|---|---|---|---|---|
| 1,873,221 | A * | 8/1932 | Senn | A63B 43/04 473/594 |
| 2,859,968 | A | 11/1958 | Modica | |
| 3,954,269 | A | 5/1976 | Brittingham | |
| 3,995,855 | A | 12/1976 | Schultz | |
| 4,194,737 | A | 3/1980 | Farmer | |
| 4,609,196 | A | 9/1986 | Bozinovic | |
| D356,355 | S | 3/1995 | Martin | |
| 9,289,657 | B1 | 3/2016 | Rice | |
| 9,795,838 | B2 * | 10/2017 | Kikel | A63B 21/023 |

* cited by examiner

*Primary Examiner* — John A Ricci

(57) ABSTRACT

A rotating spin top device for creating rotational force for a spin top includes a shell. The shell has a radius being a length between a center of the shell and an exterior surface of the shell. The shell has a cavity where a ball is nested within. The ball has a radius being a length between a center of the ball and an exterior surface of the ball. A length from the center of the ball to a center of the cavity defines a distance when the ball is positioned at an end of a pair of ends of the cavity. The radius of the ball and the radius of the shell are relative to the distance whereby defining a proportion. The proportion creates the rotational movement of the rotating spin top device.

14 Claims, 4 Drawing Sheets

ROTATING SPIN TOP DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to spin tops and more particularly pertains to a new spin top for creating rotational force for a spin top.

(2) Description of Related Art Including Information Disclosed Under 37 CFR 1.97 and 1.98

The prior art relates to spin tops. The prior art includes a variety of spherical toys having a hollow interior containing a weighted ball. Known prior art lacks a spherical toy having an interior cavity with a weighted ball whereby the radius of the ball relative to the radius of the spherical toy being a set of parameters configured for creating a rotational force of the device.

BRIEF SUMMARY OF THE INVENTION

An embodiment of the disclosure meets the needs presented above by generally comprising a shell. The shell has a radius. The radius is a length between a center of the shell and an exterior surface of the shell. The shell has a cavity. The cavity has a pair of ends. The cavity has a center. A ball is nested within the cavity of the shell. The ball has a radius. The radius of the ball is a length between a center of the ball to an exterior surface of the ball. The center of the ball is a distance from the center of the cavity when the ball is positioned at each of the ends of the cavity. A proportion is a set of parameters yielding the rotational movement of the ball within the shell. The set of parameters is a pair of variables in a fixed relationship to each other and to a constant. The pair of variables is the radius of the shell and the radius of the ball. The constant is the distance. There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
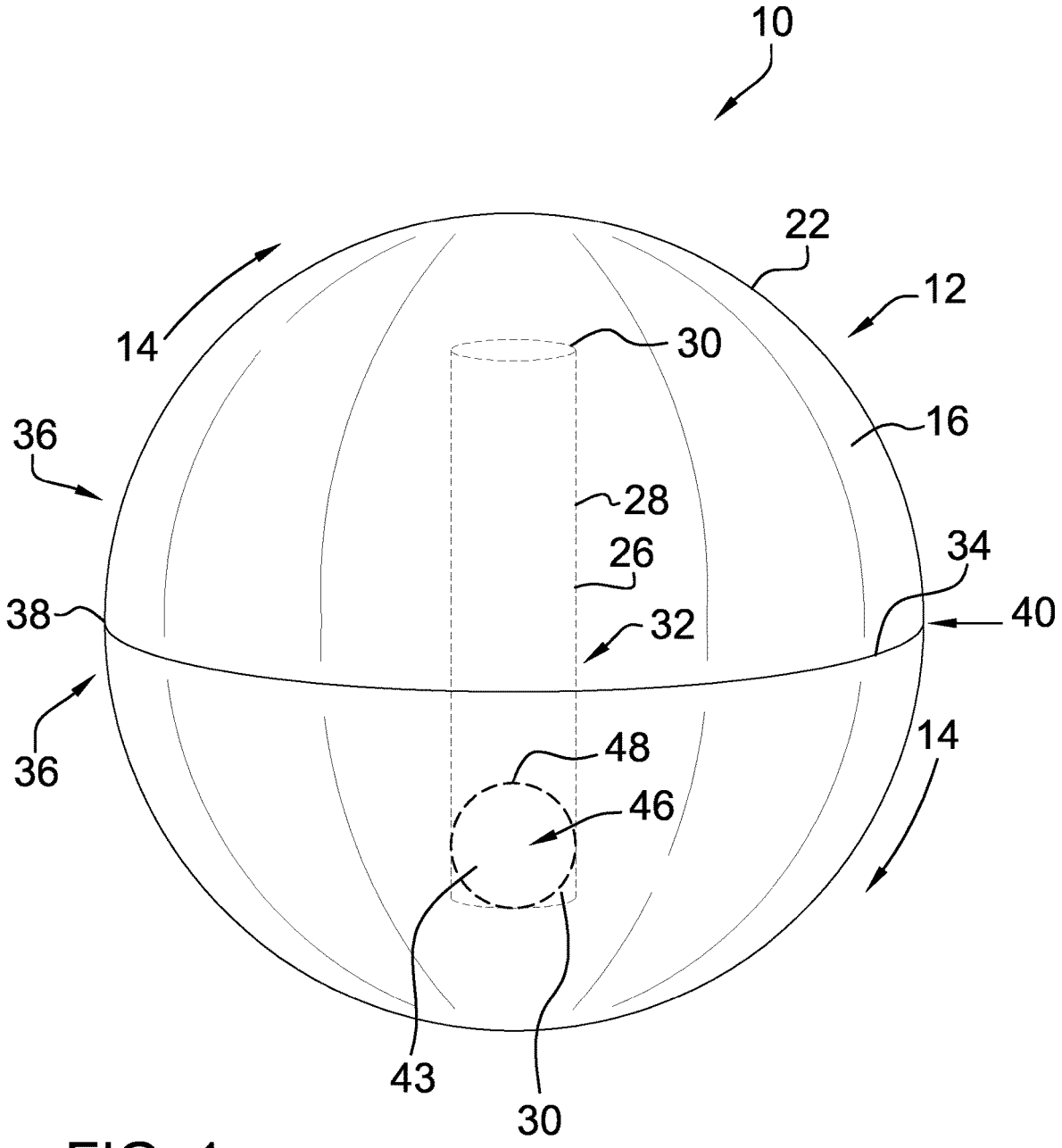
FIG. 1 is a front isometric view of a rotating spin top device according to an embodiment of the disclosure.
Figure 2:
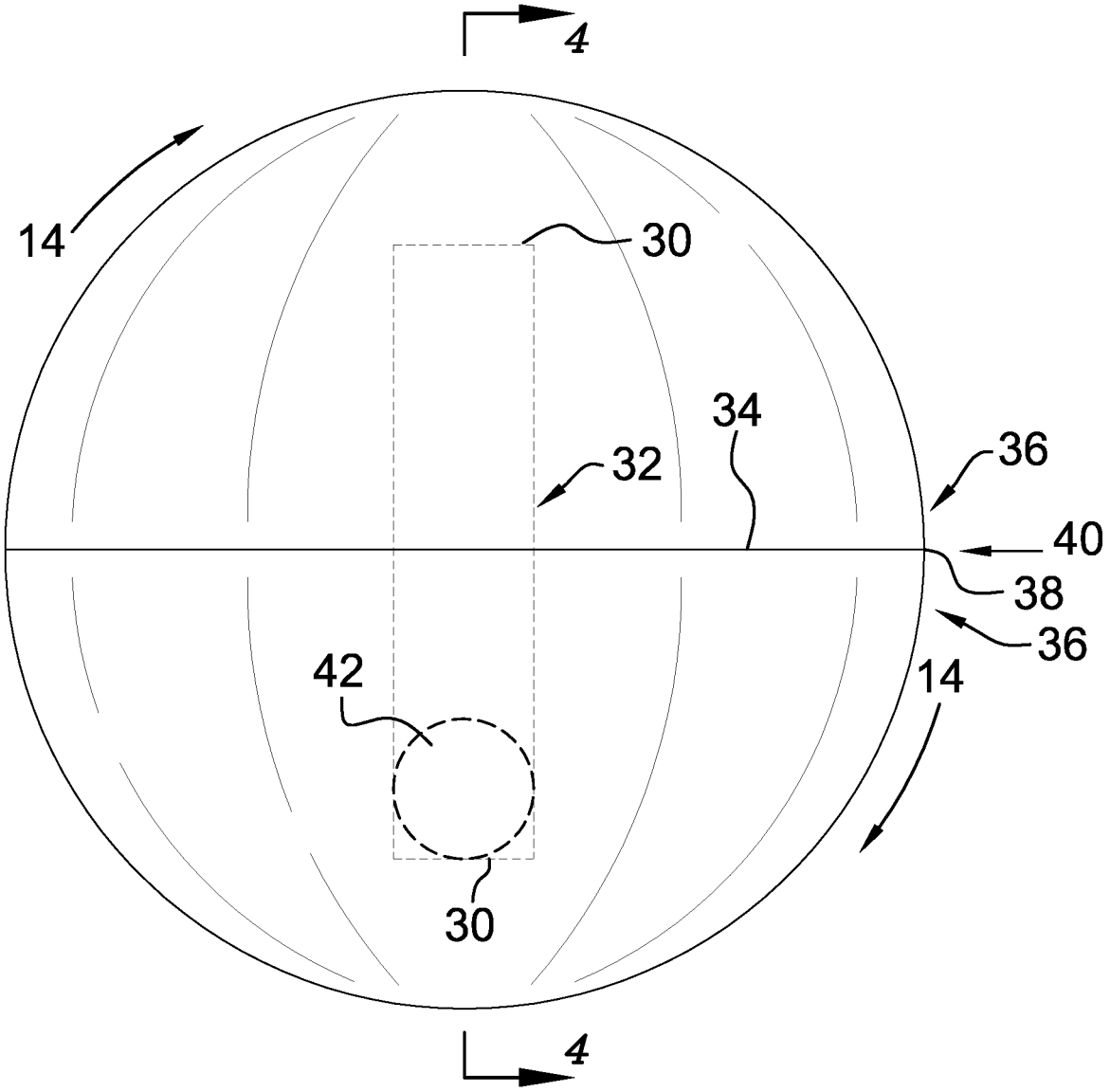
FIG. 2 is a front view of an embodiment of the disclosure.
Figure 3:
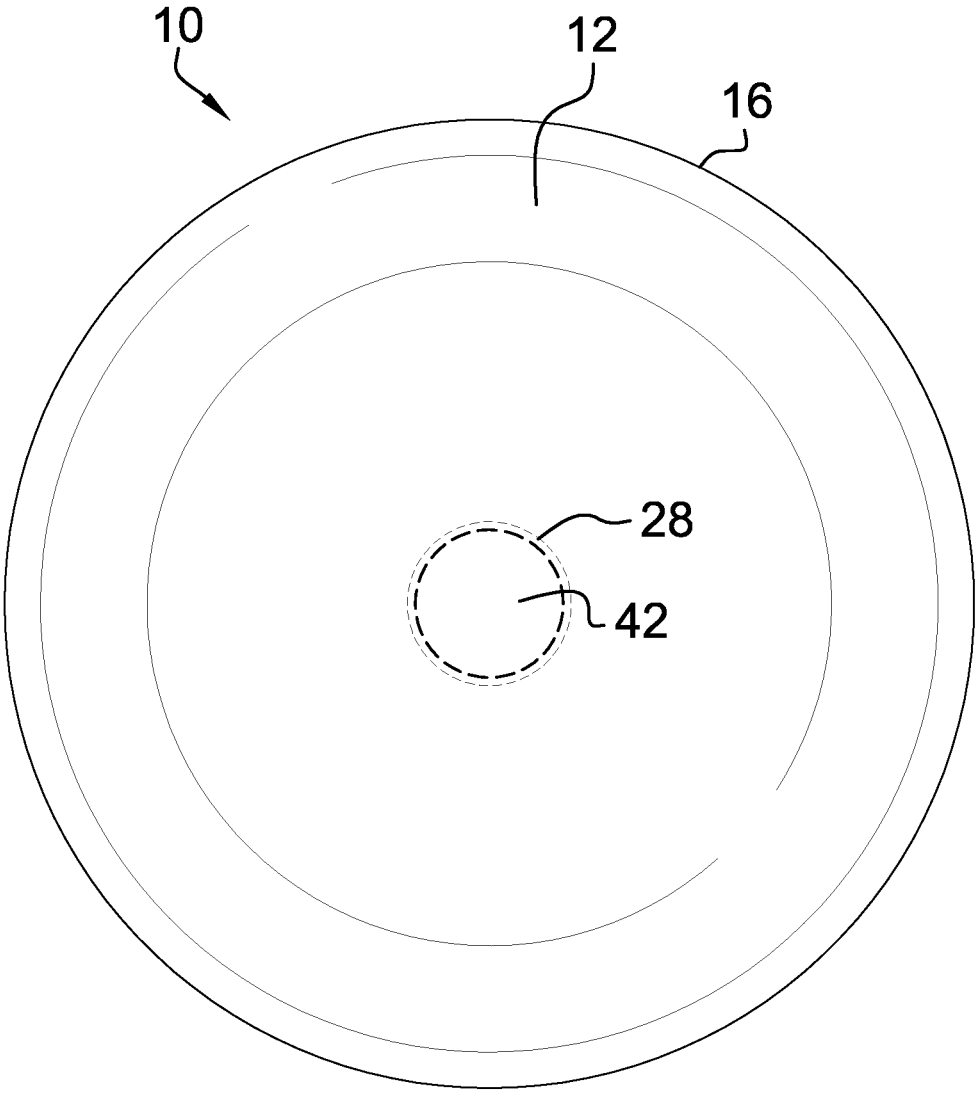
FIG. 3 is a top view of an embodiment of the disclosure.
Figure 4:
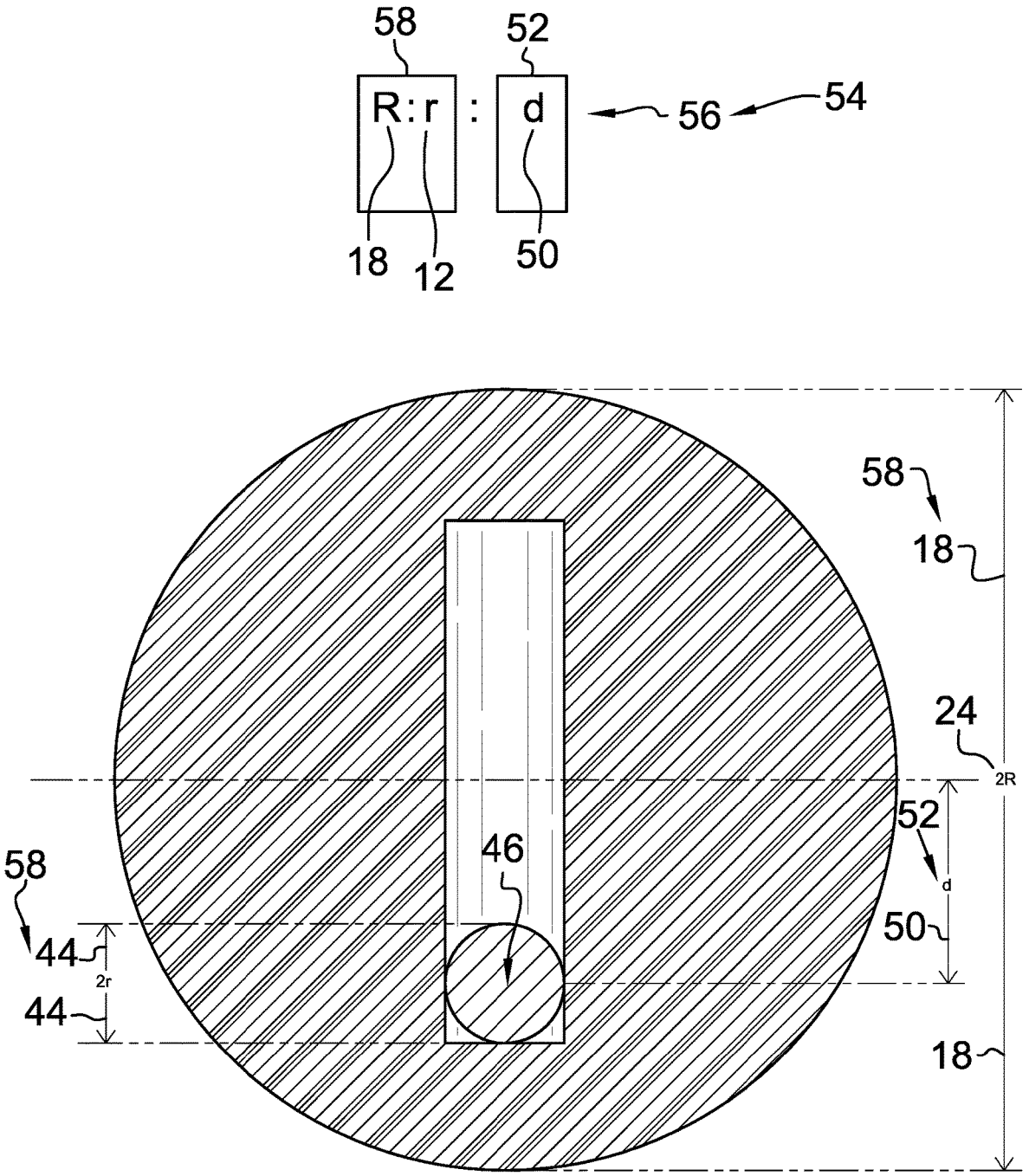
FIG. 4 is a cross-sectional view of an embodiment of the disclosure taken from FIG. 2 along Line 4-4.

With reference now to the drawings, and in particular to FIGS. 1 through 4 thereof, a new spin top embodying the principles and concepts of an embodiment of the disclosure and generally designated by the reference numeral 10 will be described.

As best illustrated in FIGS. 1 through 4, the rotating spin top device 10 generally comprises a shell 12. The shell 12 is configured for spinning around in a rotational movement 14. The shell 12 is spherical shaped 16 and has a radius 18. The radius 18 is a length between a center 20 of the shell 12 and an exterior surface 22 of the shell 12. The radius 18 of the shell 12 can be used in a variety of mathematical equations to determine a diameter 24 of the shell 12 and an area of the shell 12.

The shell 12 has a cavity 26. The cavity 26 defines a space for items to be stored within. The cavity 26 is cylindrical shaped 28 and is positioned in the center 20 of the shell 12. The cavity 26 has a pair of ends 30. Each of the ends 30 is parallel to each other. Furthermore, the cavity 26 has a center 32. The center 32 of the cavity 26 is positioned between each of the ends 30. The location of the center 32 of the cavity 26 from each of the ends 30 is equal to each other.

The shell 12 has an equatorial line 34. The equatorial line 34 is configured for dividing the shell 12 into a pair of halves 36. The equatorial line 34 is parallel to each of the ends 30 of the cavity 26, and the equatorial line 34 is coplanar with the center 32 of the cavity 26. The purpose of the equatorial line 34 is to allow the user to access the cavity 26 of the shell 12. Each of the halves 36 of the shell 12 are coupled together by an adhesive material 38. The adhesive material 38 is positioned on a surface 40 of each of the halves 36 being configured for abutting each other. The adhesive material 38 holds each of the halves 36 in a fixed position relative to each other.

A ball 42 is nested within the cavity 26 of the shell 12. The ball 42 is spherical shaped and is a steel material. The ball 42 has a radius 44 whereby the radius 44 of the ball 42 is a length from a center 46 of the ball 42 to an exterior surface 48 of the ball 42. The radius 44 of the ball 42 can be used in the variety of mathematical equations similar to the radius 18 of the shell 12. The ball 42 is configured for movement between each of the ends 30 of the cavity 26. When the ball 42 is positioned at an end 30A of the pair of ends 30 of the cavity 26, the center 46 of the ball 42 creates a distance 50 from the center 32 of the cavity 26. The distance 50 is used as a constant 52 in a proportion 54.

The proportion 54 is a set of parameters 56 yielding the rotational movement 14 of the ball within the shell 12. The set of parameters 56 is a pair of variables 58 relative to the constant 52. The pair of variables 58 is the radius 18 of the shell 12 and the radius 44 of the ball 42, whereby the constant 52 is the distance 50. The proportion 54 is configured for the pair of variables 58 to be in a fixed relationship to the constant 52. The set of parameters 56 is configured for the radius 18 of the shell 12 being 2.54 centimeters and the radius of the ball being 6.35 millimeters. Furthermore, the set of parameters 56 is configured for the distance 50 being 11 millimeters. The proportion 54 can be multiplied or divided whereby retaining the pair of variables 58 being in a fixed relationship to the constant 52.

In use, the user flicks the shell 12 into the rotational movement 14. Initially, the shell 12 spins in a smooth single direction of the rotational movement 14. As the rotational force begins to dissipate, the ball 42 within the shell 12 begins to move to and fro of each of the ends 30 of the cavity 26. This movement creates the rotational movement 14 of the shell 12 to appear as it is flipping over itself. The proportion 54 of the set of parameters 56 is essential to commencing this change in the rotational movement 14. If the pair of variables 58 was altered in their fixed relationship to the constant 52, then the flipping rotational movement would not develop as the rotational force begins to diminish.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rotating spin top device comprising:

a shell, said shell having a radius, said radius being a length between a center of said shell and an exterior surface of said shell, said shell having a cavity, said cavity having a pair of ends, said cavity having a center, said shell being configured for spinning around in a rotational direction;

a ball, said ball being nested within said cavity of said shell, said ball having a radius, said radius of said ball being a length between a center of said ball to an exterior surface of said ball, said center of said ball being a distance from said center of said cavity when said ball being positioned at each of said ends of said cavity; and a proportion, said proportion being a set of parameters yielding the rotational movement of said ball within said shell, said set of parameters being a pair of variables in a fixed relationship to each other and to a constant, said pair of variables being said radius of said shell and said radius of said ball, said constant being said distance.

2. The rotating spin top device comprising of claim 1, further comprising said shell being spherical shaped.

3. The rotating spin top device comprising of claim 1, further comprising said cavity defining a space for items to be placed.

4. The rotating spin top device comprising of claim 1, further comprising said cavity being cylindrical shaped, said cavity being positioned in said center of said shell.

5. The rotating spin top device comprising of claim 1, further comprising each of said ends of said cavity being parallel to each other.

6. The rotating spin top device comprising of claim 1, further comprising said shell having an equatorial line.

7. The rotating spin top device comprising of claim 6, further comprising said equatorial line being configured for dividing said shell into a pair of halves, said pair of halves being coupled by an adhesive material.

8. The rotating spin top device comprising of claim 7, further comprising said adhesive material being configured for retaining said pair of halves in a fixed position relative to each other whereby enclosing said cavity.

9. The rotating spin top device comprising of claim 1, further comprising said ball being spherical shaped.

10. The rotating spin top device comprising of claim 9, further comprising said ball being a steel material.

11. The rotating spin top device comprising of claim 1, further comprising said ball being configured for movement between each of said ends of said cavity.

12. The rotating spin top device comprising of claim 1, further comprising said set of parameters can be multiplied or divided whereby retaining said fixed relationship between said pair of variables to said constant.

13. The rotating spin top device comprising of claim 12, further comprising said proportion being configured for said radius of said shell being 2.54 centimeters and said radius of said ball being 6.35 millimeters whereby said distance being 11 millimeters.

14. A rotating spin top device comprising:

a shell, said shell being spherical shaped, said shell having a radius, said radius being a length between a center of said shell and an exterior surface of said shell, said shell having a cavity, said cavity defining a space for items to be placed, said cavity being cylindrical shaped, said cavity being positioned in said center of said shell, said cavity having a pair of ends, each of said ends being parallel to each other, said cavity having a center, said shell having an equatorial line, said equatorial line being configured for dividing said shell into a pair of halves, said pair of halves being coupled by an adhesive material, said adhesive material being configured for retaining said pair of halves in a fixed position relative to each other whereby enclosing said cavity, said shell being configured for spinning around in a rotational direction;

a ball, said ball being spherical shaped, said ball being a steel material, said ball being nested within said cavity of said shell, said ball having a radius, said radius of said ball being a length between a center of said ball to an exterior surface of said ball, said ball being configured for movement between each of said ends of said cavity, said center of said ball being a distance from said center of said cavity when said ball being positioned at each of said ends of said cavity; and a proportion, said proportion being a set of parameters yielding the rotational movement of said ball within said shell, said set of parameters being a pair of variables in a fixed relationship to each other and to a constant, said pair of variables being said radius of said shell and said radius of said ball, said constant being said distance, said set of parameters can be multiplied or divided whereby retaining said fixed relationship between said pair of variables to said constant, said proportion being configured for said radius of said shell being 2.54 centimeters and said radius of said ball being 6.35 millimeters whereby said distance being 11 millimeters.

* * * * *